United States Patent [19]

Teague

[11] 4,082,193

[45] Apr. 4, 1978

[54] PIPE HANDLING APPARATUS

[75] Inventor: J. T. Teague, Longview, Tex.

[73] Assignee: LeRoy LaSalle, Carthage, Tex.

[21] Appl. No.: 57,640

[22] Filed: Jul. 23, 1970

[51] Int. Cl.[2] ..... E21B 19/00

[52] U.S. Cl. ..... 214/2.5; 104/112; 175/85; 212/73; 212/77; 214/1 P

[58] Field of Search ..... 214/1 P, 2.5, 1 R, 13, 214/14, 15 R, 94; 212/73, 75, 72, 74, 76–123; 104/112–114, 115–117, 183, 178; 175/85, 52

[56] References Cited

U.S. PATENT DOCUMENTS

| | | | |
|---|---|---|---|
| 657,330 | 9/1900 | Chandler | 104/112 X |
| 736,996 | 8/1903 | Miller | 212/72 |
| 890,306 | 6/1908 | Schmertz | 214/2.5 X |
| 1,281,914 | 10/1918 | Douchamp | 214/3.1 |
| 2,371,887 | 3/1945 | Hamilton, Jr. | 212/77 X |
| 2,448,324 | 8/1948 | Pool | 214/2.5 |
| 3,011,653 | 12/1961 | Larsen | 212/91 |
| 3,330,223 | 7/1967 | Gaynor | 104/178 X |
| 3,368,699 | 2/1968 | Scaggs | 214/2.5 |

FOREIGN PATENT DOCUMENTS

| | | | |
|---|---|---|---|
| 1,189,622 | 4/1970 | United Kingdom | 212/72 |
| 931,520 | 7/1963 | United Kingdom | 212/72 |

*Primary Examiner*—Frank E. Werner
*Attorney, Agent, or Firm*—Donald Gunn

[57] ABSTRACT

As a preferred embodiment of the invention disclosed herein, a winch is stationed to one side of an oil field derrick and a cable spooled on the winch extended over a pipe rack and secured at a convenient location above the derrick floor. A pair of spaced pulleys or carriages are independently pulled along the extended portion of the taut cable by a pair of selectively-controlled winches respectively carrying a cable or wire coupled to the carriages. Pipe carriers are dependently coupled to the carriages and operatively arranged for carrying a pipe laid between the carriers in a nearly-horizontal position as the selectively-controlled winches move the carriages along the extended cable between the derrick floor and the pipe rack. The pipe section is selectively raised or lowered over the pipe rack by operating the first winch to either tighten or slack off on the extended cable.

9 Claims, 7 Drawing Figures

Figures 1A, 1B:
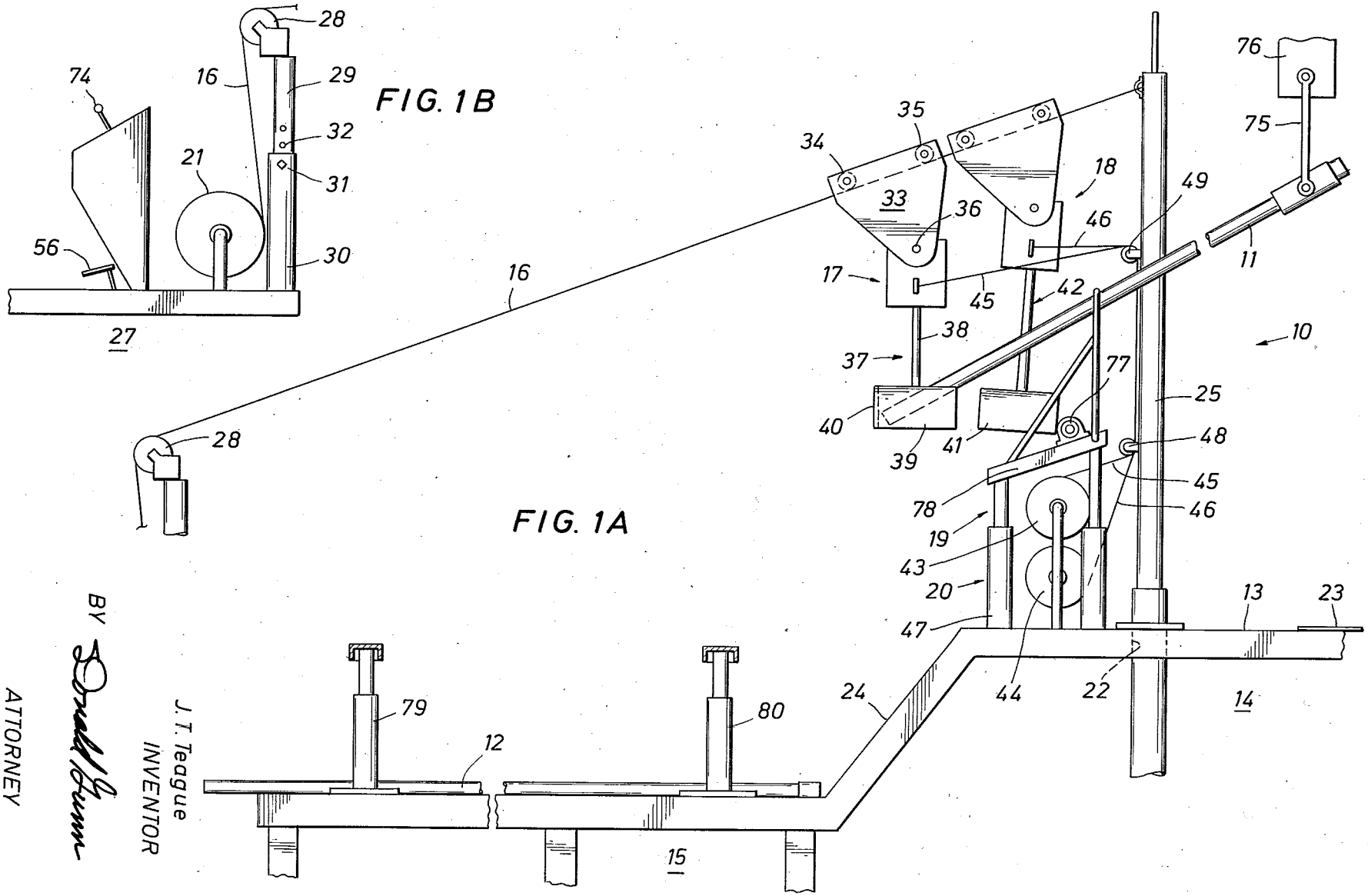

J. T. Teague
INVENTOR

BY Donald Gunn

ATTORNEY

J. T. Teague
INVENTOR

BY Donald Gunn

ATTORNEY

J. T. Teague
INVENTOR

BY Donald Gunn

ATTORNEY

PIPE HANDLING APPARATUS

During the course of a typical well drilling operation, it is often necessary to transport sections or joints of pipe to and from the work platform or floor of the drilling rig. To lower a pipe to the ground in the usual manner, so-called "elevators" which are dependently coupled to the traveling block of the derrick's hoisting apparatus are releasably secured to the upper end of each pipe joint and the lower end of the pipe is swung over and laid onto an inclined "skid board" which is positioned between the edge of the rig floor and suitable horizontal pipe racks on the ground. As the hoisting machine is operated to lower the pipe, it will slide down the skid board; and, once the elevators are released, the pipe is manually guided onto the pipe racks where it can then be rolled to a desired location. On the other hand, pipes are typically raised to the rig floor by securing a winch line or so-called "cat line" to the upper portion to a pipe joint and pulling it longitudinally up the skid board. Once the pipe is adjacent to the rig floor, the elevators are coupled to its upper end and the hoisting machinery is operated to raise the pipe in the derrick for movement into an upright storage rack.

It will be appreciated, therefore, that these typical pipe-handling procedures are extremely hazardous to those working around the drilling rig as pipes are being moved onto or off of the rig floor. Moreover, the lower ends of pipe joints are sometimes damaged during these pipe-handling operations.

Accordingly, it is an object of the present invention to provide new and improved pipe-handling apparatus which is particularly adapted for efficiently and safely moving sections of pipe onto and off of oil field platforms with a minimum risk of damage to the pipe sections.

This and other objects of the present invention are accomplished by supporting a cable at a first location adjacent to an oil field platform, and extending the cable over pipe racks to a second location above the platform. First and second pipe-carrying means are mounted at spaced intervals on the cable and, when the cable is tightened, adapted to travel therealong for transporting pipe sections supported across the pipe-carrying means. Means are operatively coupled to the first and second pipe-carrying means and adapted for independently controlling their movements along the taut cable. Means are operatively coupled to the cable and adapted for selectively tightening or loosening the cable to raise and lower its extended portion in relation to the pipe racks.

Figure 2:
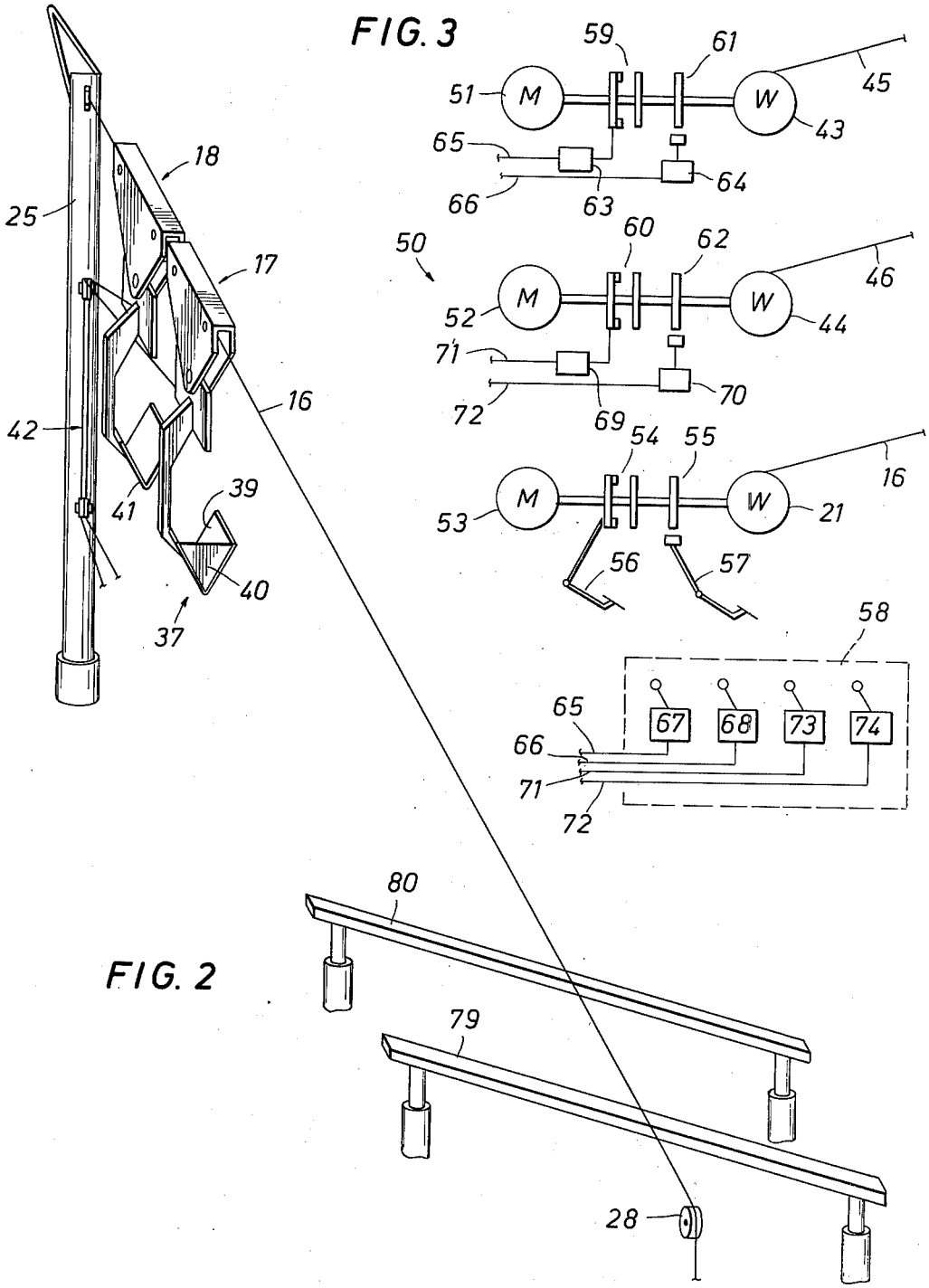
Figure 4:
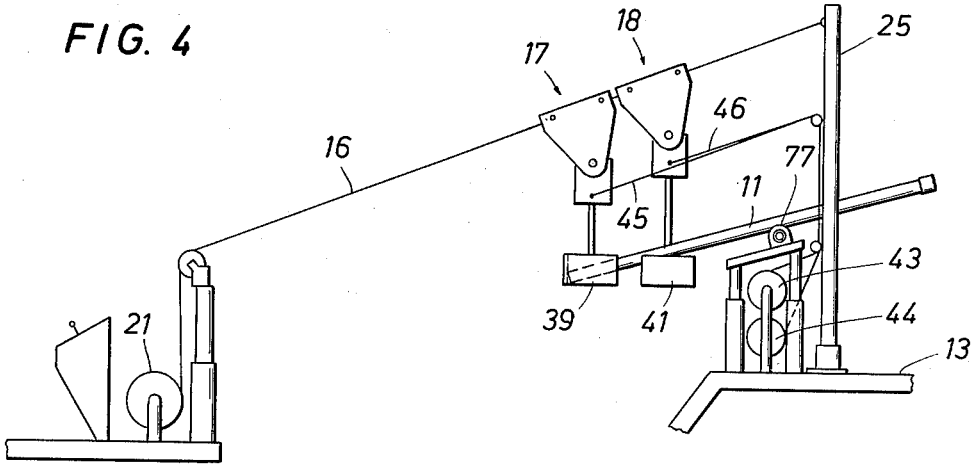
Figure 5:
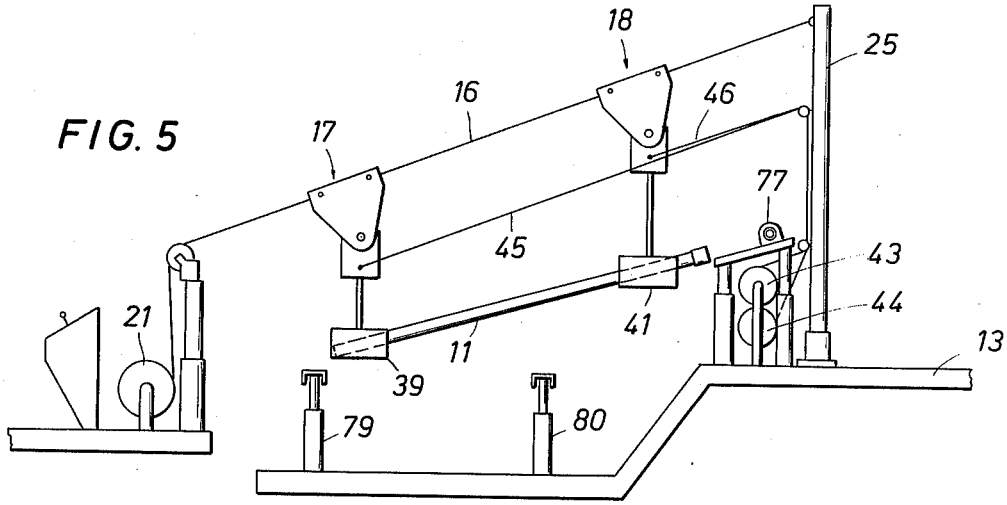
Figure 6:
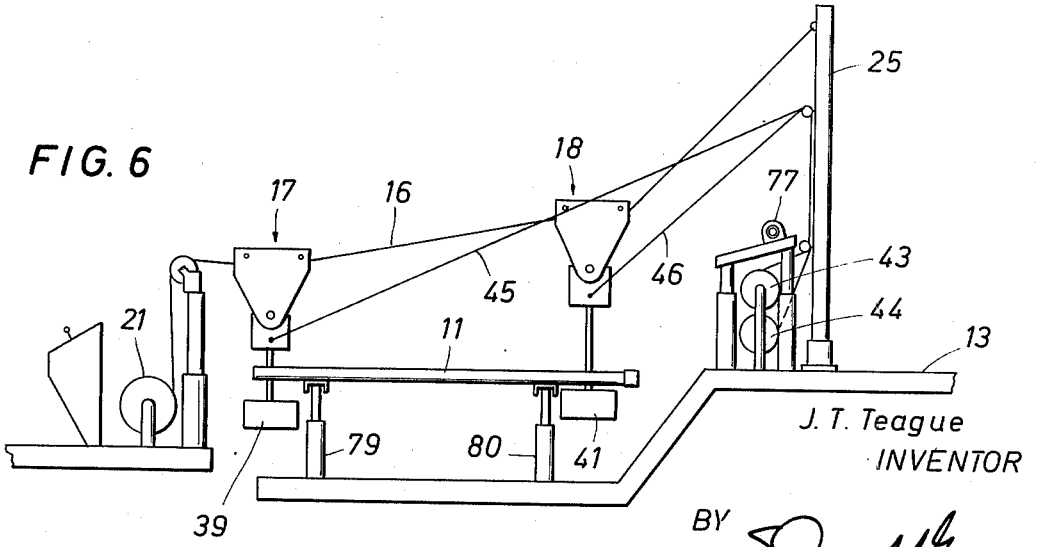

The novel features of the present invention are set forth with particularity in the appended claims. The invention, together with further objects and advantages thereof, may be best understood by way of the following description of exemplary apparatus employing the principles of the invention as illustrated in the accompanying drawings, in which:

FIGS. 1A, 1B and 2 depict different views of a preferred embodiment of pipe-handling apparatus of the present invention as it will appear when being employed in conjunction with the typical oil field drilling derrick;

FIG. 3 schematically illustrates a preferred arrangement of a control system for the pipe-handling apparatus of the present invention; and FIGS. 4–6 are similar to FIG. 1 but show successive positions of the apparatus as the pipe section is being transported between the drilling derrick and a pipe rack adjacent thereto.

Turning now to FIGS. 1A, 1B and 2, elevational views are shown of a preferred embodiment of the new and improved pipe-handling apparatus 10 of the present invention as it would typically be arranged for transporting one or more joints of pipe, as at 11 and 12, between the elevated platform or floor 13 of a drilling rig 14 and the pipe rack 15 adjacent thereto. As illustrated, the pipe-handling apparatus 10 includes a cable 16 which is secured at a convenient elevated location above the rig floor 13 and inclined downwardly over the pipe rack 15 to a second elevated location therebeyond. First and second pipe-carrying means 17 and 18 are movably coupled to the extended portion of the cable 16 and adapted for transporting pipe sections, as at 11, in a nearly-horizontal position between the rig floor 13 and the pipe rack 15. To selectively control the travel of the pipe-carrying means 17 and 18 back and forth across the extended portion of the cable 16, first and second movement-controlling means 19 and 20 are respectively coupled to the first and second pipe-carrying means and adapted for independently controlling their movements in a manner which will subsequently be explained. A selectively-operable winch 21 is cooperatively coupled to the cable 16 and arranged for alternately raising the extended portion of the cable as required for lifting pipe sections, as at 12, off of the pipe rack 15 or for lowering the cable to place a pipe section, as at 11, on the rack.

On a typical drilling rig as at 14, a hole 22 (commonly designated the "mouse hole") is located between the power-driven rotary table 23 and an inclined platform or so-called "pipe skid" 24 which is positioned between the pipe rack 15 and the adjacent edge of the rig floor 13. Thus, for convenience, the pipe-handling apparatus 10 includes an upright portable mast 25 which is inserted in the mouse hole 22 and suitably braced or secured below the rig floor 13 as required to maintain the mast in a generally-upright position. A ring 26 is arranged near the upper end of the mast 25 for securing the cable 16 at a selected height above the rig floor 13.

In the preferred arrangement of the pipe-handling apparatus 10, the cable 16 is spooled on the powered winch 21 which is mounted on a portable skid or the bed 27 of a truck which is stationed adjacent the pipe rack 15 in general alignment with the pipe skid 24 and the portable mast 25. To elevate the cable 16 well above the pipe rack 15, the cable is directed upwardly from the winch 21 and passed over an upright sheave 28 journalled on top of an erect mast 29 which is best mounted on the truck bed 27 just in front of the winch. As illustrated, it is preferred to make the height of the mast 29 adjustable by telescopically arranging the mast in an upright tubular base 30 and releasably securing the telescoped members to one another by fitting a bolt 31 in one of several spaced holes 32 through the two members.

As shown in FIGS. 1A and 2, the pipe-carrying means 17 preferably include a closely-spaced pair of upright, generally-triangular plates as at 33 which straddle the cable 16 and are movably suspended thereon by a pair of transversely-oriented rollers 34 and 35 journalled at spaced intervals between the upper edges of the two plates. A transversely-oriented pivot 36 is arranged through the lower corners of the plates 33 for dependently suspending a pipe carrier 37 directly under the pivot. The pipe carrier 37 is preferably arranged as an elongated, generally C-shaped bar 38 dependently supporting an upturned, V-shaped plate 39 which is adapted to receive the lower end of a pipe such as at 11. A transverse plate or bar 40 is secured across the open end of the plate 39 facing the winch 21 to prevent the end of the pipe 11 from slipping downwardly out of the upturned plate. It will, therefore, be appreciated that, by virtue of the upturned plate 39, the pipe carrier 37 is particularly suited for transporting pipe sections between the rig floor 13 and the pipe rack 15 since it is necessary only to lay the end of the pipe into the V-shaped plate. The pipe-carrying means 18 are preferably arranged in generally the same manner as the pipe-carrying means 17. It will be recognized, of course, that the V-shaped support plate 41 for the other pipe carrier 42 does not require a transverse and plate or bar as at 40 since the upturned plate is intended to fully cradle the underside of an intermediate portion of a pipe joint as at 11.

In the preferred embodiment of the pipe-handling apparatus 10, the first and second movement-controlling means 19 and 20 are respectively comprised of first and second selectively-powered winches 43 and 44 having cables 45 and 46 spooled thereon which are coupled to the pipe-carrying means 17 and 18. To facilitate their transportation, the winches 43 and 44 are mounted adjacent to or one above the other on a portable skid or base 47 which, for the sake for convenience, is best positioned on the rig floor 13 at the foot of the portable mast 25. With this arrangement, it is preferred to mount one or more sets of guide rollers, as at 48 and 49, at spaced intervals on the mast 25 to direct the cables 45 and 46 upwardly to a suitable elevated location from whence they can better be respectively extended to the pipe-carrying means 17 and 18. It will, therefore, be appreciated that by operating the winch 43 to pay out the cable 45, the pipe-carrying means 17 will be free to move downwardly along the inclined portion of the cable 16. Conversely, by operating the winch 43 to wind in the cable 45, the pipe-carrying means 17 will be pulled upwardly along the taut cable 16. The pipe-carrying means 18 are, of course, similarly moved upwardly and downwardly along the tightened cable 16 by selectively operating the winch 44 in alternate rotative directions.

The winches 43 and 44 must, of course, be selectively controlled so as to permit the pipe-carrying means 17 and 18 to be moved independently of one another. Similarly, the winch 21 must also be capable of selective control for regulating the tension in the extended portion of the cable 16. Accordingly, in the preferred manner of accomplishing this, a control system 50 is arranged as shown in FIG. 3. As depicted there, the winches 43 and 44 are respectively coupled to suitable drivers such as fluid-powered or electrical motors 51 and 52 which can be selectively driven in alternate rotational directions as required for moving the pipe-carrying means 17 and 18 back and forth along the cable 16. The winch 21 is similarly coupled to a selectively-controlled driver or motor 53. As is typical, a clutch 54 and a brake 55 are operatively arranged between the winch 21 and the motor 53 for regulating the operation of the winch. Since the winch 21 and its associated driving apparatus are located on the truck bed 27, the clutch 54 and the brake 55 are preferably operated by typical foot pedals 56 and 57.

On the other hand, since the winches 43 and 44 are preferably located on the rig floor 13, it is preferred to regulate the operation of these winches by suitable controls which are conveniently located on a panel 58 mounted on the truck bed 27 above the foot pedals 56 and 57. Accordingly, remotely-operated clutches 59 and 60 and brakes 61 and 62 are respectively employed for selectively coupling the drivers 51 and 52 to the winches 43 and 44. To accomplish this, typical electrical, hydraulic, or pneumatic actuators, as at 63 and 64, are operatively arranged for actuating the clutch 59 and the brake 61, with the actuators being respectively coupled by suitable control lines 65 and 66 to appropriate electrical, hydraulic or pneumatic controls 67 and 68 mounted on the control panel 58. Similar actuators 69 and 70 are provided for the clutch 60 and the brake 62 and respectively coupled by control lines 71 and 72 to similar controls 73 and 74 on the panel 58. It will, of course, be appreciated that a suitable supply (not shown) of electrical power or compressed air will be required where the control system 50 is powered in either manner. On the other hand, if the control system 50 is hydraulically operated, the several controls and actuators described above can be conveniently arranged as a self-contained hydraulic system with these controls respectively providing the motivating pressures for operating the actuators. The arrangements of any of these several systems are, of course, well known to those skilled in the art.

Referring again to FIGS. 1A and 1B, it will be noted that the pipe section 11 has been previously lowered by the derrick elevators 75 to a position where the lower end of the pipe could be manually moved over onto the pipe carrier 37. It will, of course, be realized by those skilled in the art that even heavy sections of drill pipe or drill collars are typically shifted across the rig floor in this manner. Thus, no particular effort is required for a skilled workman to guide the lower end of the pipe section 11 into the position on the pipe carrier 37 illustrated in FIG. 1B.

Accordingly, once the lower end of the pipe section 11 is resting on the pipe carrier 37, the traveling block 76 and the elevators 75 are lowered as the winch 43 is operated to unreel the cable 45 at a controlled speed. Thus, as best seen in FIG. 4, by slowly paying out the cable 45 to move the carrier 37 outwardly along the taut cable 16 as the elevators 75 are being lowered, the pipe section 11 will be safely moved into a generally-horizontal position and come to rest on a transversely-oriented roller 77 which is preferably mounted across the top of the framework 78 supporting the winches 43 and 44. Once this is accomplished, the elevators 75 can be safely unlatched from the upper end of the pipe section 11.

As illustrated in FIG. 4, once the pipe section 11 is supported between the pipe carrier 37 and the roller 77, the pipe carrier 42 will be positioned just below the mid-section of the pipe. Thus, as depicted in FIG. 5, by unreeling the cable 46 on the winch 44 so as to allow the weight of the pipe 11 to carry the leading pipe carrier 37 further downwardly along the taut cable 16, the trailing portion of the pipe section will move downwardly in relation to the still-stationary pipe carrier 42 and come to rest on the upturned plate 41 before the upper end of the pipe has moved off of the roller 77. Then, once the pipe 11 is safely cradled in the two pipe carriers 37 and 42, the winches 43 and 44 are operated in unison to allow the cables 45 and 46 to slowly unreel so that the pipe-carrying means 17 and 18 will move downwardly along the taut cable 16 and bring the pipe into position over the pipe rack 15.

Once the pipe section is over the pipe rack 15, the winches 43 and 44 are stopped to halt the further downward travel of the pipe carrying means 17 and 18 along the still-tightened cable 16. Then, as illustrated in FIG. 6, the winch 21 is operated to slowly slack-off on the cable 16 so as to lower the pipe section 11 in a generally-horizontal position onto a pair of pipe-supporting members, as at 79 and 80, which are appropriately located on the pipe rack 15. It will, of course, be appreciated that by arranging the supports 79 and 80 to provide a slightly-inclined ramp, the pipe 11 will readily roll onto the rack 15 once the pipe carriers 37 and 42 are dropped below the horizontally-supported pipe.

Once the pipe 11 is rolled out of the path of the pipe carriers 37 and 42, the winch 21 is operated to retighten the cable 16 and the winches 43 and 44 are operated to return the pipe-carrying means 17 and 18 to their initial positions as shown in FIG. 1A for receiving another pipe section. It will, of course, be appreciated that by properly coordinating the operation of the several winches 21, 43 and 44, the above-described operations can be quickly performed with complete safety and full control of the movements of the pipe section 11 at all times.

A reversed sequence is followed to raise pipes from the pipe rack 15 onto the rig floor 13. Thus, with the pipe-handling apparatus 10 generally in the position illustrated in FIG. 6, after a pipe section is moved up onto the pipe supports 79 and 80, the winch 21 is operated to bring the pipe-carrying means 17 and 18 into engagement with the pipe 11. Once the pipe 11 is safely secured or positioned on the pipe-carrying means 17 and 18, the winch 21 is operated to tighten the cable 16 and raise the pipe off of the pipe supports 79 and 80. Thereafter, as illustrated in FIG. 5, as the winches 43 and 44 are operated in unison to pull the pipe-carrying means 17 and 18 upwardly along the tightened cable 16, the pipe section 11 will be transported upwardly along the cable toward the rig floor 13. Once the leading end of the pipe section 11 has passed over the roller 77, the winch 21 is operated to slightly lower the cable 16 until the upper portion of the pipe has come to rest on the roller so that the pipe carrier 42 can be uncoupled from the pipe section. The elevators 75 are coupled to the leading end of the pipe section 11 and then hoisted to drag the pipe across the roller 77 and remove the trailing end of the pipe from the pipe carrier 37. Then, as the elevators 75 continue to hoist the pipe 11 up into the derrick, the pipe will roll along the roller 77 until its trailing end clears the roller so that the pipe will then be suspended vertically in the derrick for movement to a desired position.

Accordingly, it will be appreciated that the new and improved pipe-handling apparatus of the present invention is particularly suited for safely moving heavy pipe joints back and forth between the drilling platform and pipe racks adjacent thereto. By arranging a selectively-tightened cable between the drilling platform and the pipe racks, spaced pipe carriers can be moved along the cable while it is tightened. Then, by simply relieving tension on the cable, a pipe section supported between the carriers can be safely lowered to a desired position. To independently control the movements of the pipe carriers, lines respectively coupled to the carriers are spooled on selectively-controlled winches which are operatively arranged for moving the carriers back and forth along the cable.

While a particular embodiment of the present invention has been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Pipe-handling apparatus adapted for transporting oil field piping between spaced oil field platforms and comprising: a cable winch adapted for placement at a first location, said cable winch having a cable spooled thereon adapted for extension from said cable winch over a first oil field platform to a second oil field platform therebeyond; means adapted for securing said cable at a second location above the second platform; selectively-operable winch-driving means coupled to said cable winch and adapted for operating said cable winch to selectively tighten or loosen said cable; first and second pipe-carrying means adapted for movement between said locations along the extended portion of said cable when said cable is tightened; and first and second movement-controlling means respectively coupled to said first and second pipe-carrying means and selectively operable for independently moving said first and second pipe-carrying means back and forth along said extended cable portion, and wherein said first movement-controlling means includes a first winch having a first pulling line spooled thereon and adapted for coupling to said first pipe-carrying means, and first driving means coupled to said first winch and selectively operable for driving said first winch to move said first pipe-carrying means along said extended cable portion, and wherein said second movement-controlling means includes a second winch having a second pulling line spooled thereon and adapted for coupling to said second pipe-carrying means, and second driving means coupled to said second winch and operable for driving said second winch to move said second pipe-carrying means along said extended cable portion.

2. Pipe-handling apparatus adapted for transporting oil field piping between a drilling platform and a pipe rack adjacent thereto and comprising: a cable winch adapted for placement at a first location adjacent to a pipe rack, said cable winch having a cable spooled thereon adapted for extension from said cable winch over the pipe rack to a second location above the drilling platform therebeyond; means adapted for securing said cable at said second location; first and second pipe carriers respectively adapted to be coupled onto the extended portion of said cable for travel therealong between said first and second locations; first and second control winches having first and second control lines spooled thereon and respectively adapted for coupling to said first and second pipe carriers for independently pulling said pipe carriers along said cable; first and second winch-control means respectively coupled to said first and second control winches and adapted to independently drive said control winches for selectively regulating the independent movements of said first and second pipe carriers on said cable to selectively move said first and second pipe carriers therealong between said first and second locations; and selectively-operable driving means coupled to said cable winch and adapted for selectively tightening said cable for accommodating travel of said first and second pipe carriers therealong and for selectively loosening said cable for lowering said first and second pipe carriers.

3. The pipe-handling apparatus of claim 2 wherein said first and second pipe carriers respectively include a trolley adapted for rolling along said cable, and pipe-supporting means dependently suspended below said trolley and adapted for carrying a pipe supported in a generally-horizontal position between and below said first and second pipe carriers.

4. The pipe-handling apparatus of claim 2 wherein said cable-securing means include an upright mast adapted for placement on a well-drilling platform, and means adapted for securing the free end of said cable near the upper end of said mast.

5. The pipe-handling apparatus of claim 4 further including pipe-guiding means operatively associated with said mast and adapted for guiding one portion of a pipe onto one of said pipe carriers after another portion of that pipe is on the other of said pipe carriers and as said other pipe carrier is being moved along said cable away from said one pipe carrier.

6. The pipe-handling apparatus of claim 5 wherein said first and second pipe carriers respectively include a trolley adapted for rolling along said cable, and pipe-supporting means dependently suspended below said trolley and adapted for carrying a pipe supported in a generally-horizontal position between and below said first and second pipe carriers.

7. The pipe-handling apparatus of claim 5 wherein said pipe-guiding means include a pipe roller mounted adjacent to said mast, and a pipe guide on said mast adapted for guiding a pipe onto said roller as it is being lowered.

8. Apparatus for handling pipe wherein the pipe is transported between a pipe rack and another location comprising: a cable; means forming spaced apart pipe receiving carriages; means mounting said spaced apart pipe receiving carriages for longitudinal movement on said cable; means for moving at least one of said carriage on said cable; and means anchoring one end of said cable; means controlling the tension in said cable; said cable adapted to be positioned with part of it disposed in overlying relationship with respect to the pipe rack and part of it being disposed in close proximity to the recited another location; said means for moving said carriages including a second cable, said second cable being attached to at least one of said carriages; and, means for moving said second cable so as to enable positioning of a carriage to which said cable is attached; means forming at least one of said pipe receiving carriages into a trough for bottom supporting a pipe, said trough being upwardly opening with downwardly coverging side walls, and further including a vertically disposed bulkhead for abuttingly receiving the end of a pipe joint thereagainst.

9. Apparatus for handling pipe wherein the pipe is transported between a pipe rack and another location comprising:

(a) a cable;
(b) means forming a pair of pipe receiving carriages;
(c) means mounting said pipe receiving carriages for longitudinal movement along said cable so that they may support a pipe of specified length;
(d) moving means for moving at least one of said carriages along said cable;
(e) means anchoring one end of said cable;
(f) means controlling the tension in said cable to raise or lower said cable;
(g) said cable adapted to be positioned with part of it disposed in space in overlying relationship with respect to the pipe rack and part of it extending upwardly to be disposed in close proximity to the recited another location so that said cable enables raising or lowering movement of said carriages;
(h) said moving means including a second cable;
(i) said second cable being attached to at least one of said carriages;
(j) means for moving said second cable to selectively position the carriage to which said cable is attached; and
(k) means forming at least one of said pipe receiving carriages for supporting a pipe, and further including means for temporarily supporting a pipe on said pipe receiving carriages during raising or lowering movement of the pipe along said cable.

* * * * *